US007348951B2

(12) United States Patent
Aoki

(10) Patent No.: US 7,348,951 B2
(45) Date of Patent: Mar. 25, 2008

(54) CIRCUIT AND METHOD FOR DRIVING ELECTRO-OPTICAL DEVICE, ELECTRO-OPTICAL DEVICE, AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 519 days.

(21) Appl. No.: 11/092,676

(22) Filed: Mar. 30, 2005

(65) Prior Publication Data

US 2005/0275611 A1 Dec. 15, 2005

(30) Foreign Application Priority Data

Jun. 11, 2004 (JP) ..... 2004-174747

(51) Int. Cl.
*G09G 3/36* (2006.01)

(52) U.S. Cl. ..... 345/87; 345/94; 345/100

(58) Field of Classification Search ..... 345/87–104, 345/204, 211, 690
See application file for complete search history.

(56) References Cited

U.S. PATENT DOCUMENTS 5,528,257 A 6/1996 Okumura et al.
6,894,669 B2 5/2005 Suzuki et al.
6,943,763 B2 * 9/2005 Shibata et al. ..... 345/89
7,158,107 B2 * 1/2007 Kawabe et al. ..... 345/89
7,277,076 B2 * 10/2007 Shiomi et al. ..... 345/89
2002/0140652 A1 * 10/2002 Suzuki et al. ..... 345/87
2005/0068343 A1 * 3/2005 Pan et al. ..... 345/690

FOREIGN PATENT DOCUMENTS

JP A-04-288589 10/1992
JP A-07-020828 1/1995
JP A-2003-143556 5/2003
JP A-2003-241721 8/2003

* cited by examiner

*Primary Examiner*—Jimmy H. Nguyen
(74) *Attorney, Agent, or Firm*—Oliff & Berridge, PLC

(57) ABSTRACT

A circuit for driving an electro-optical device has a plurality of pixel portions that contain an electro-optical material responsive to an electric signal. The circuit includes a driving unit that supplies an image signal corresponding to one screen to the pixel portions in each of a plurality of unit periods into which a screen display period for displaying the one screen is divided so that the pixel portions are driven a plurality of times in the screen display period. The circuit further includes a correction unit that corrects the image signal supplied in the first unit period of the plurality of unit periods in the same screen display period with correction data. The correction data is determined using the amount of change with respect to an image signal supplied in a screen display period previous to the first unit period and a response speed of the electro-optical material to the image signal.

9 Claims, 14 Drawing Sheets

CIRCUIT AND METHOD FOR DRIVING ELECTRO-OPTICAL DEVICE, ELECTRO-OPTICAL DEVICE, AND ELECTRONIC APPARATUS

BACKGROUND OF THE INVENTION

1. Technical Field

The present invention relates to a circuit and method for driving an electro-optical device, e.g., a liquid crystal device. The invention also relates to an electro-optical device, and to an electronic apparatus including such an electro-optical device, such as a projector.

2. Related Art

One electro-optical device is a liquid crystal device. Various driving methods of liquid crystal devices have been conceived in order to reduce display failure during driving. Generally, polarity-inversion driving methods are used to prevent flicker on display screens, image burn-in on liquid crystal monitors, or image quality degradation. For example, in field-inversion driving or frame-inversion driving, polarities of image signals are inverted for every field or frame. In row-inversion driving or column-inversion driving, polarities of image signals are inverted for every row or column while being inverted for every frame or field.

In another driving method of the related art, a correction value corresponding to the amount of data change between adjacent frames is used to avoid display blur resulting from the low response speed of liquid crystal to an applied voltage or image signal. The low response speed of liquid crystal increases the brightness transition time in response to applied voltages, and causes insufficient effective luminance. In this case, the value of the image signal is increased to reduce the time for reaching the target brightness, or the effective luminance is compensated.

This compensation is known as "overdrive."

The above-described methods and techniques are combined in order to enhance effects or make up for defects. However, compensation to improve the response speed of liquid crystal while preventing flicker by inversion driving is technically difficult, and it is therefore difficult to ensure high image quality.

SUMMARY

An advantage of the invention is that it provides a circuit and method for driving an electro-optical device capable of displaying an image with high quality, an electro-optical device driven by this circuit, and an electronic apparatus including the electro-optical device.

According to a first aspect of the invention, a circuit for driving an electro-optical device including a plurality of pixel portions that contain an electro-optical material responsive to an electric signal includes a driving unit that supplies an image signal corresponding to one screen to the pixel portions in each of a plurality of unit periods into which a screen display period for displaying the one screen is divided so that the pixel portions are driven a plurality of times in the screen display period, and a correction unit that corrects the image signal supplied in the first unit period of the plurality of unit periods in the same screen display period with correction data, the correction data being determined using the amount of change with respect to an image signal supplied in a screen display period previous to the first unit period and a response speed of the electro-optical material to the image signal.

During driving, the pixel portions are driven by the driving unit a plurality of times in a screen display period. The pixel portions are thus driven at double speed or n-times speed, where n is an integer more than one. More specifically, for example, an image signal corresponding to one field or one frame read in a buffer is read from the buffer at double speed or n-times speed for the period of one field or one frame, and the image signal corresponding to one screen (e.g., one field or one frame) is written repetitively n times into the pixels for a shorter period than one field or one frame. Focusing on one pixel portion, n identical image signals are supplied to this pixel portion in a given screen display period. That is, the same image signal is repetitively supplied to the pixels at every unit period in this screen display period. The values of the supplied image signals vary along a change or motion in a displayed image for every screen display period.

The double-speed driving improves the response of liquid crystal to the applied voltage, or has an effect in increasing the luminance up to a certain level appropriate for the image signal. The time for applying a voltage to the liquid crystal one time can also be reduced, and flicker or crosstalk on a displayed image can also be prevented while reducing image quality degradation and image burn-in on the liquid crystal monitor.

The correction unit may further overdrive the screen in response to the image signal. In this case, the screen is overdriven in response to an image signal supplied in at least the first unit period of unit periods into which a screen display period is divided.

For example, in motion pictures with a rapid brightness change between screens, when a white image moves on a black background, the liquid crystal cannot follow a change of image signal. In this case, the trajectory of the white image is perceived as a white trailing tail along with the movement of the white image, resulting in afterimage artifacts. In overdriving, the electric potential of the image signal is varied with respect to the brightness change to adjust an offset of the liquid crystal driving voltage, and, typically, the image signal, namely, the luminance signal, is corrected for the brightness. As described above, an identical image signal is written in any unit period in one screen display period. Thus, correction in terms of offset adjustment is not necessary between unit periods, but is necessary in the unit period subsequent to the previous screen display period (i.e., in the first unit period).

Specifically, the image signal supplied in the first unit period in each screen display period is corrected based on correction data that is determined using the amount of change with respect to an image signal supplied in a screen display period previous to the first unit period and a response speed of the liquid crystal. The signal value is greatly varied with respect to a large amount of change or a low response speed to forcibly change alignment of the liquid crystal to the target orientation to accelerate the nominal response of the liquid crystal.

According to the inventors' study, a typical overdrive system may be used to correct all image signals supplied in one screen display period. The optimum response of liquid crystal is instantaneous response to a rapid change of electric potential at boundary in a screen display period with the desirable rising or falling edge in brightness. It is therefore effective to correct the image signal early in a screen display period. Accordingly, afterimage artifacts on the display screen due to response delay of the liquid crystal can efficiently be reduced or overcome.

This driving method allows double-speed driving and overdriving in response to an image signal supplied in the first unit period in each screen display period, thus displaying an image with high quality.

It is preferable that the correction unit does not correct an image signal that is supplied in the unit periods other than the first unit period in the same screen display period.

Therefore, only an image signal supplied in the first unit period in each screen display period is corrected. Since identical image signals are repetitively supplied in unit periods in a screen display period, correction involved with a brightness change may be performed on only the image signal supplied in the first unit period, thus achieving efficient overdriving. Moreover, the time for applying an excessive voltage as a correction value can be minimized with respect to the overall driving period. Therefore, the effects described above can be achieved while suppressing image quality degradation on the liquid crystal screen.

It is preferable that the correction unit corrects an image signal that is supplied in the unit periods other than the first unit period in the same screen display period and the image signal supplied in the first unit period using weighted correction values.

Therefore, the image signal supplied in the first unit period in each screen display period and the image signals supplied in the unit periods other than the first unit period in each screen display period are corrected. The unit periods other than the first unit period include at least one of the second to n-th unit periods in n unit periods into which one screen display period is divided, where n is an integer more than one. The unit periods other than the first unit period may be all or a portion of the second unit period to the n-th unit period, or may be a plurality of periodically selected unit periods, e.g., the second, fourth, and sixth unit periods.

The image signal supplied in the first unit period and the image signals supplied in the unit periods other than the first unit period are corrected using weighted correction values. That is, the amount of correction is distributed from the first unit period that can be the most effective to the following unit periods. For example, the correction value for the first unit period may be most highly weighted, and the correction values for the following unit periods may be reduced in turn.

This compensation is useful particularly when the response of the liquid crystal is not sufficient with compensation performed in the first unit period, e.g., when the amount of brightness change is large or when the response speed of liquid crystal is low. A combination of this compensation and overdriving allows alignment of the liquid crystal to be changed to the target alignment state if alignment of the liquid crystal is not fully changed after the first unit period, thus efficiently accelerating the nominal response of the liquid crystal.

In this case, compensation can be performed stepwise in unit periods, thus reducing the amount of correction in the first unit period compared to compensation performed only in the first unit period. Therefore, image quality degradation on the liquid crystal screen caused by an image signal with large variations due to the amount of correction can be suppressed.

It is preferable that the correction unit determines a luminance difference between the image signal supplied in the first unit period and the image signal supplied in the previous screen display period to set a correction value according to the determined difference, and corrects the image signal supplied in a designated unit period including the first unit period based on the set correction value.

Therefore, in order to correct the image signal by overdriving, first, a luminance difference between the image signal supplied in the first unit period and the image signal supplied in the screen display period previous to the first unit period is determined. The correction value is set depending upon the determined difference, and the image signal supplied in a designated unit period is corrected based on the set correction value.

The correction value may be determined in proportion to the determined difference value, or may be set to zero if the difference is below a predetermined threshold, i.e., the image signal may not be corrected. The correction value may be determined by digital signal processing. With the data operation described above, overdriving can relatively easily be performed.

It is preferable that the driving unit drives the pixel portions so that polarities of the pixel portions are inverted with respect to a reference voltage for every screen display period or for every unit period.

Therefore, during driving, the image signals supplied to the pixel portions are inverted in polarity with respect to a reference voltage for every picture display period or for every unit period. The polarities of the liquid crystal driving voltage are inverted at a certain interval, thus preventing image quality degradation and image burn-in on the liquid crystal screen.

Polarity-inversion driving methods include a line-inversion method and a field/frame-inversion method. The field/frame-inversion driving method that is less susceptible to a lateral electric field is effective for narrow pitch circuit boards. In the field/frame-inversion driving method, however, applied voltages to a positive field (or positive frame) and a negative field (or negative frame) are asymmetric with respect to a midpoint potential, and the liquid crystal driving voltage varies in the vertical direction each time a field (or frame) is switched. This phenomenon is generally perceived as a periodic brightness change for a field period with a frequency of about 30 Hz, that is, flicker.

In an embodiment of the invention, on the other hand, with the use of double-speed driving, the flicker frequency is doubled to, for example, 60 Hz when polarities are inverted for every unit period, which is enough high that flicker is not perceived. The field/frame-inversion driving method prevents the occurrence of lateral electric field and flicker, and realizes a narrow pitch circuit board while maintaining high image quality.

It is preferable that the driving unit drives a display screen composed of the plurality of pixel portions, the display screen is divided into a plurality of screen sections including a first screen section composed of groups of pixel portions and a second screen section composed of groups of pixel portions, the first and second screen sections being adjacent to each other, the groups of pixel portions constituting the first screen section being not adjacent to each other, by horizontally scanning the groups of pixel portions constituting the first screen section and the groups of pixel portions constituting the second screen section in an alternate manner so that the groups of pixel portions constituting the first screen section are driven with field/frame inversion at a first interval and the groups of pixel portions constituting the second screen section are driven with field/frame inversion at a second interval complementary to the first interval.

Therefore, the display screen is divided into first and second screen sections, and the first and second screen sections are driven with field/frame inversion. The first and second screen sections are driven so as to have opposite polarities in each field period. Each of the first and second screen sections is a region including at least two lines (that is, a region including two or more scanning lines) for field/frame inversion driving. The term "field/frame inversion driving" means a driving method in which the polarities of image signals are inverted each time one screen is produced (in other words, each time an image signal is supplied at every field or frame), and the polarities are inverted for every screen display period or for every unit period. The groups of pixel portions constituting the first and second screen sections are horizontally scanned in an alternate manner, and image signals are simultaneously written in parallel.

The display screen is driven with field/frame inversion on a region-by-region basis allows each screen section to be refreshed two times while one screen is refreshed. One vertical period for an input image signal is therefore halved, and polarity inversion appropriate to the double-speed driving method can therefore be performed.

According to a second aspect of the invention, an electro-optical device includes the circuit for driving the electro-optical device according to the first aspect of the invention, and the plurality of pixel portions.

The electro-optical device according to the second aspect of the invention includes the circuit for driving the electro-optical device according to the first aspect of the invention, thus displaying an image with high quality. The electro-optical device may be implemented as a liquid crystal device, an electrophoretic device, e.g., electric paper, a field emission display, a surface-conduction electron-emitter display, etc.

According to a third aspect of the invention, an electronic apparatus includes the electro-optical device according to the second aspect of the invention.

The electronic apparatus according to the third aspect of the invention includes the electro-optical device according to the second aspect of the invention, thus displaying an image with high quality. The electronic apparatus may be implemented as, for example, a projection display device, a liquid crystal television (TV) set, a portable phone, an electronic organizer, a word processor, a viewfinder or direct-monitor video tape recorder, a workstation, a TV phone, a POS (point-of-sale) terminal, a touch-panel, etc.

According to a fourth aspect of the invention, a method for driving an electro-optical device including a plurality of pixel portions that contain an electro-optical material responsive to an electric signal includes supplying an image signal corresponding to one screen to the pixel portions in each of a plurality of unit periods into which a screen display period for displaying the one screen is divided so that the pixel portions are driven a plurality of times in the screen display period, and correcting the image signal supplied in the first unit period of the plurality of unit periods in the same screen display period with correction data, the correction data being determined using the amount of change with respect to an image signal supplied in a screen display period previous to the first unit period and a response speed of the electro-optical material to the image signal.

The method for driving the electro-optical device according to the fourth aspect of the invention achieves similar effects and advantages to those of the circuit for driving the electro-optical device according to the first aspect of the invention.

BRIEF DESCRIPTION OF THE DRAWINGS

The invention will be described with reference to the accompanying drawings, wherein like numbers reference like elements, and wherein.

DESCRIPTION OF THE EMBODIMENTS

An electro-optical device according to embodiments of the invention will be described with reference to the drawings in the context of a liquid crystal device.

First Embodiment

An electro-optical device according to a first embodiment of the invention will be described with reference to FIGS. 1 to 13.

Figure 1:
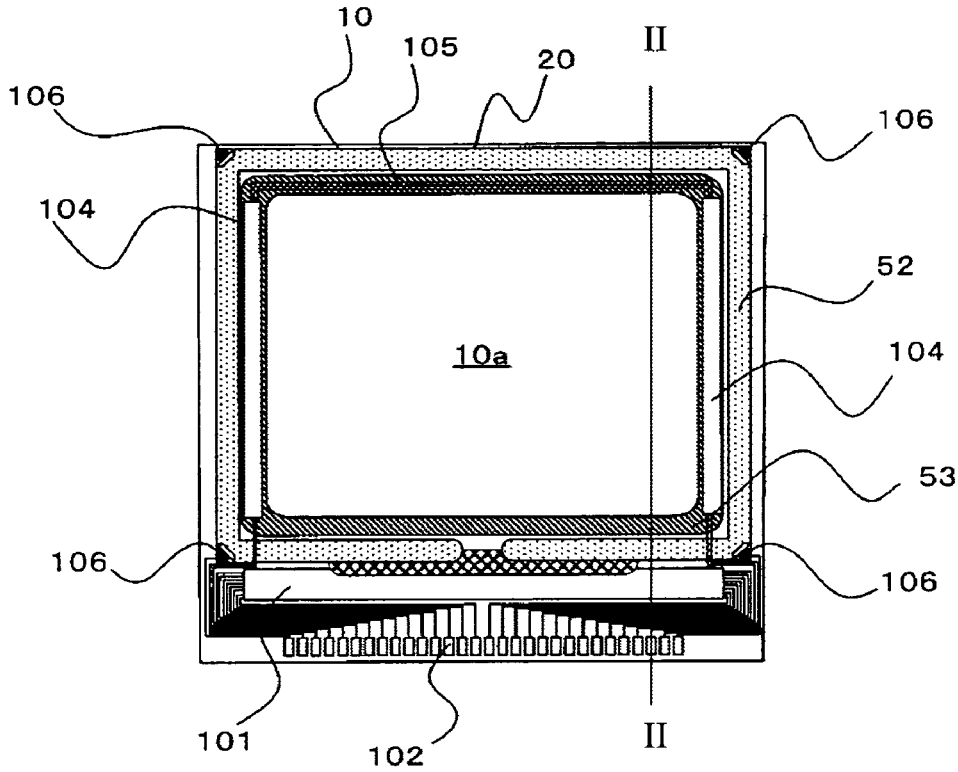
FIG. 1 is a plan view of an electro-optical device.
Figure 2:
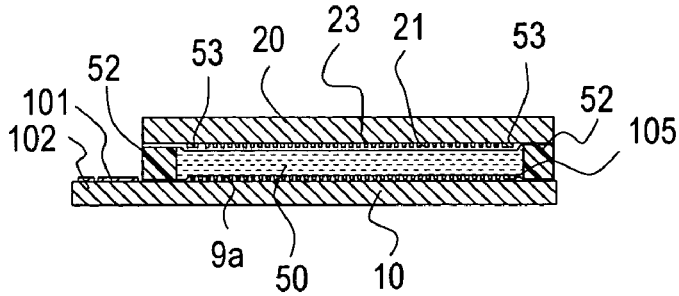
FIG. 2 is a cross-sectional view of the electro-optical device shown in FIG. 1, taken along a line II-II.
Figure 3:
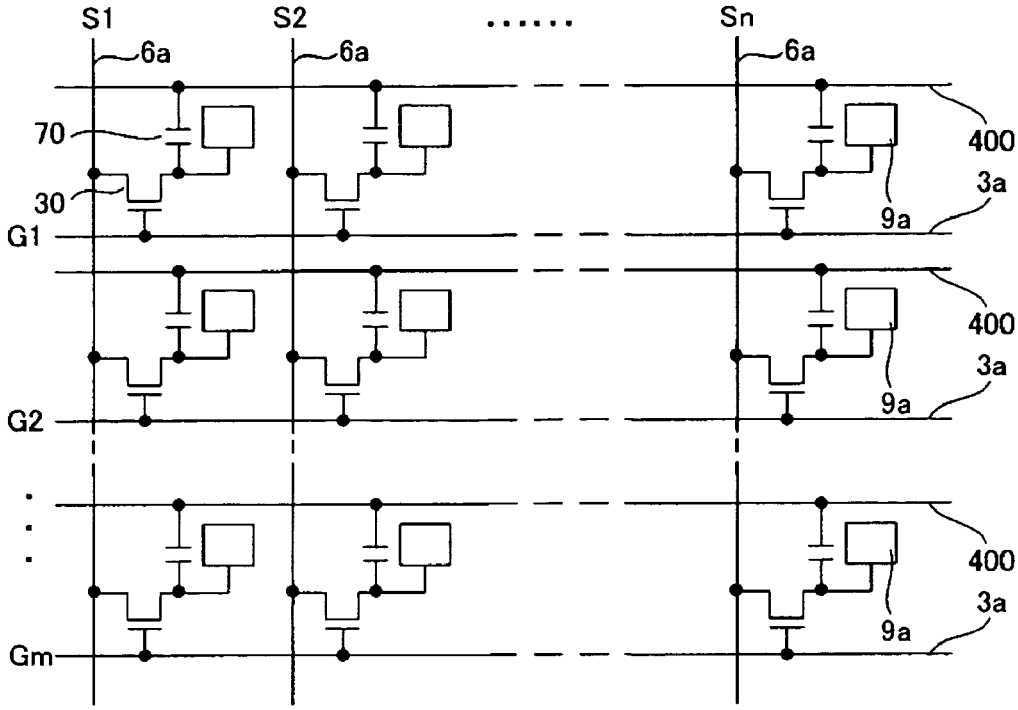
FIG. 3 is an equivalent circuit diagram of elements and lines in a plurality of pixel portions arranged into a matrix in an image display region of the electro-optical device.
Figure 4:
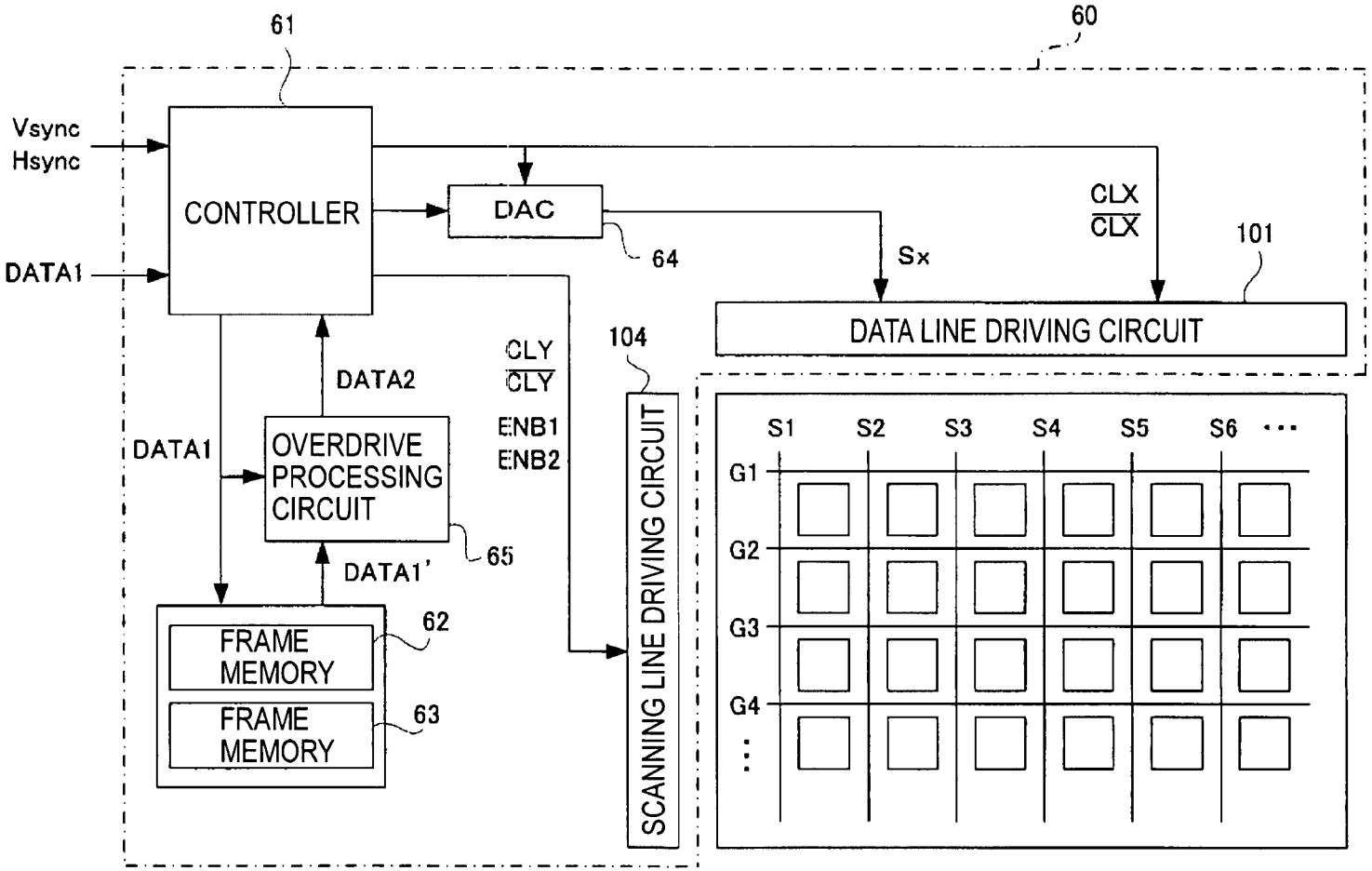
FIG. 4 is a block diagram of a driving system of an electro-optical device according to a first embodiment of the invention.

The structure of the electro-optical device according to the first embodiment will be described with reference to FIGS. 1 to 4. FIG. 1 is a plan view of the electro-optical device, showing a thin-film transistor (TFT) array substrate 10 and components formed on the substrate 10, as viewed from a counter substrate 20, and FIG. 2 is a cross-sectional view of the electro-optical device shown in FIG. 1, taken along a line II-II. FIG. 3 shows an equivalent circuit of pixel portions in the electro-optical device according to the first embodiment. FIG. 4 is a block diagram of driving unit 60.

Referring to FIGS. 1 and 2, in the electro-optical device according to the first embodiment, the TFT array substrate 10 and the counter substrate 20 face each other with a liquid crystal layer 50 encapsulated therebetween. The TFT array substrate 10 and the counter substrate 20 are bonded to each other by a sealant 52 disposed in a seal area around an image display region 10*a*.

The sealant 52 used for bonding the substrates 10 and 20 is made of, for example, ultraviolet (UV) curable resin, thermosetting resin, or the like, which is disposed onto the TFT array substrate 10 and is then cured by exposure to UV light, heat, or the like in the manufacturing process. Spacers made of material, such as glass fiber or glass bead, are dispersed in the sealant 52 to keep the gap (inter-substrate gap) at a predetermined spacing between the TFT array substrate 10 and the counter substrate 20. The electro-optical device according to the first embodiment is useful for compact and enlargement display applications, e.g., a light valve of a projector.

A frame light-shielding film 53 is formed on the counter substrate 20 so as to define a frame region of the image display region 10*a* along the inner periphery of the seal area in which the sealant 52 is disposed. All or a portion of the frame light-shielding film 53 may be formed on the TFT array substrate 10 as an internal light-shielding film.

In the peripheral region around the image display region 10*a*, a data line driving circuit 101 and an external circuit connection terminal 102 are disposed along one side of the TFT array substrate 10 outside the seal area in which the sealant 52 is disposed. Scanning line driving circuits 104 are also disposed along two sides adjacent to the side along which the data line driving circuit 101 and an external circuit connection terminal 102 are disposed. The scanning line driving circuits 104 are covered with the frame light-shielding film 53. A plurality of wiring lines 105 for connecting the scanning line driving circuits 104 with the image display region 10*a* therebetween are disposed along the remaining side of the TFT array substrate 10, and the plurality of wiring lines 105 are covered with the frame light-shielding film 53.

Conducting members 106 serving as conducting terminals between both substrates are disposed at four corners of the counter substrate 20. On the TFT array substrate 10, conducting terminals are disposed at the position facing the conducting members 106. These conducting members 106 and terminals allow electrical conduction between the TFT array substrate 10 and the counter substrate 20.

In FIG. 2, pixel switching TFTs and pixel electrodes 9*a* that overlie wiring lines are formed on the TFT array substrate 10, and are coated with an alignment layer. Counter electrodes 21 and a lattice-shaped or stripe-shaped light-shielding film 23 are formed on the counter substrate 20, and are coated with an alignment layer. The liquid crystal layer 50 is made of, for example, one kind of nematic liquid crystal or a mixture of several kinds of nematic liquid crystal, and is aligned in a predetermined state between the pair of alignment layers.

Other than the data line driving circuit 101, the scanning line driving circuits 104, etc., the TFT array substrate 10 may also include a sampling circuit for sampling image signals on image signal lines and supplying the sampled image signals to data lines, a pre-charge circuit for supplying pre-charge signals having predetermined voltage levels to the data lines prior to the image signals, an inspection circuit for inspecting the quality, defects, etc., of the electro-optical device during manufacturing or at the time of shipment, etc.

As shown in FIG. 3, the image display region 10*a* includes a plurality of scanning lines 3*a* and a plurality of data lines 6*a* so as to intersect each other, and pixel portions are arranged at intersections of the lines 3*a* and 6*a* so as to be selected by one of the scanning lines 3*a* and one of the data lines 6*a*. Each pixel portion includes a TFT 30, a pixel electrode 9*a*, and a capacitor 70. The TFTs 30 are designed so as to apply image signals S1, S2, . . . , Sn supplied from the data lines 6*a* to selected pixels. A gate of each TFT 30 is connected to the scanning line 3*a*, a source is connected to the data line 6*a*, and a drain is connected to the pixel electrode 9*a*. The pixel electrodes 9*a* form liquid crystal capacitance together with the counter electrodes 21, described below, and apply the input image signals S1, S2, . . . , Sn to the pixel portions so as to hold them for a certain period of time. One electrode of each capacitor 70 is connected to the drain of the TFT 30 in parallel to the pixel electrode 9*a*, and the other electrode is connected to a capacitor line 400 with a fixed electric potential so as to have a constant electric potential.

The electro-optical device is of, for example, the TFT active-matrix driving type. The scanning line driving circuits 104 (see FIG. 1) applies scanning signals G1, G2, . . . , Gm to the scanning lines 3*a* in the order described below, and the data line driving circuit 101 (see FIG. 1) applies the data signals S1, S2, . . . , Sn via the data lines 6*a* to the selected horizontal rows of the pixel portions including the TFTs 30 that are turned on by the scanning signals G1, G2, . . . , Gm. The data signals S1, S2, . . . , Sn may be sequentially supplied to the data lines 6*a*, or may be supplied to a set of (e.g., a group of) the data lines 6*a* at the same time. Therefore, the image signals are supplied to the pixel electrodes 9*a* associated with selected pixels. The TFT array substrate 10 faces the counter substrate 20 with the liquid crystal layer 50 therebetween (see FIG. 2). An electric field is applied to the liquid crystal layer 50 for each of the arranged pixel portions, and the amount of light transmitted between both substrates is controlled for each pixel portion to display a grayscale image. The image signals held in the pixel portions are prevented from leaking by the capacitor 70.

As shown in FIG. 4, in the electro-optical device according to the first embodiment, the driving unit 60 includes the data lines driving circuit 101, the scanning line driving circuit 104, a controller 61, frame memories 62 and 63 for two screens, a digital-to-analog (DA) converter 64, and an overdrive processing circuit 65 serving as a correction unit.

The controller 61 receives a vertical synchronization signal Vsync, a horizontal synchronization signal Hsync, and an image signal DATA1, and controls operation timings of the components based on the vertical synchronization signal Vsync and the horizontal synchronization signal Hsync. Specifically, the controller 61 controls write/read operation of the frame memories 62 and 63 and controls an operation timing of the overdrive processing circuit 65. The frame memories 62 and 63 are used alternately, e.g., for every frame, so that the externally input image signal DATA1 corresponding to one frame is temporarily stored in one of the frame memories 62 and 63 while the stored image signal DATA1 is output from the other memory for display. The image signal DATA1 is a voltage signal, e.g., an RGB signal, representing the brightness of each of red (R), green (G), and blue (B), at least before it is written into the frame memories 62 and 63. Although not shown, an additional signal processing circuit, such as an RGB matrix circuit, may be provided before or after the controller 61.

The overdrive processing circuit 65 corrects the image signal DATA1, which is the original signal of an image signal Sx, by overdriving to make alignment of the liquid crystal in the liquid crystal layer 50 responsive to the image signal Sx. More specifically, the image signal DATA1 is corrected for the brightness by varying the signal DATA1, and a corrected image signal DATA2 is output.

The DA converter 64 performs DA conversion on the image signal read from the frame memories 62 and 63 or the overdrive processing circuit 65, and outputs the converted signal to the data lines driving circuit 101. The data lines driving circuit 101 applies the input image signal Sx to the corresponding data lines 6*a* in response to a clock signal CLX and an inverted clock signal CLX' input from the controller 61.

The scanning line driving circuit 104 performs basic line-sequential horizontal scanning in response to a clock signal CLY and an inverted clock signal CLY' input from the controller 61, as described in detail below. The scanning line driving circuit 104 generates and outputs two start pulses at the same time with a single driving circuit configuration, and applies scanning signals Gx to the scanning lines 3*a* in the order described below in response to enable signals ENB1 and ENB2 for shifting output timings of the scanning signals.

A method for driving the electro-optical device will now be described. In this electro-optical device, the driving unit 60 allows double-speed driving with polarity inversion, and overdriving during driving. First, polarity inversion driving at double speed will be described with reference to FIGS. 5 to 10, and overdriving will then be described with reference to FIGS. 11 to 13.

Figure 5:
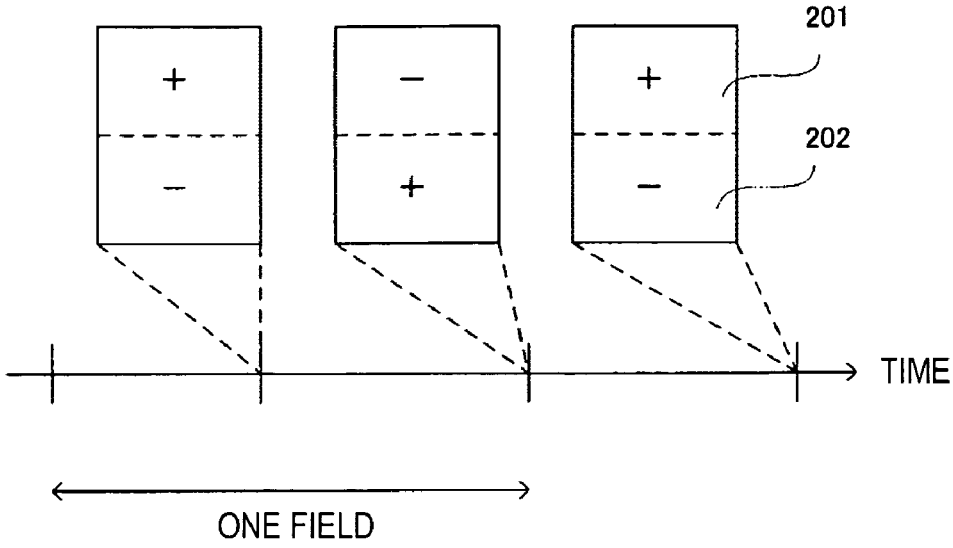
FIG. 5 is a diagram showing a method for driving the electro-optical device according to the first embodiment.
Figure 6:
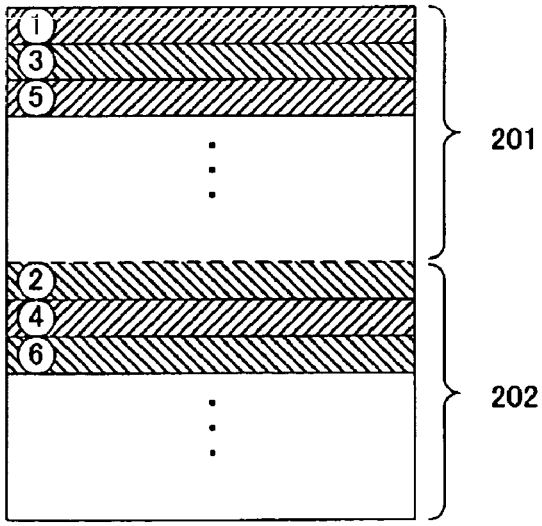
FIG. 6 is a diagram showing a method for driving the electro-optical device according to the first embodiment.
Figure 7:
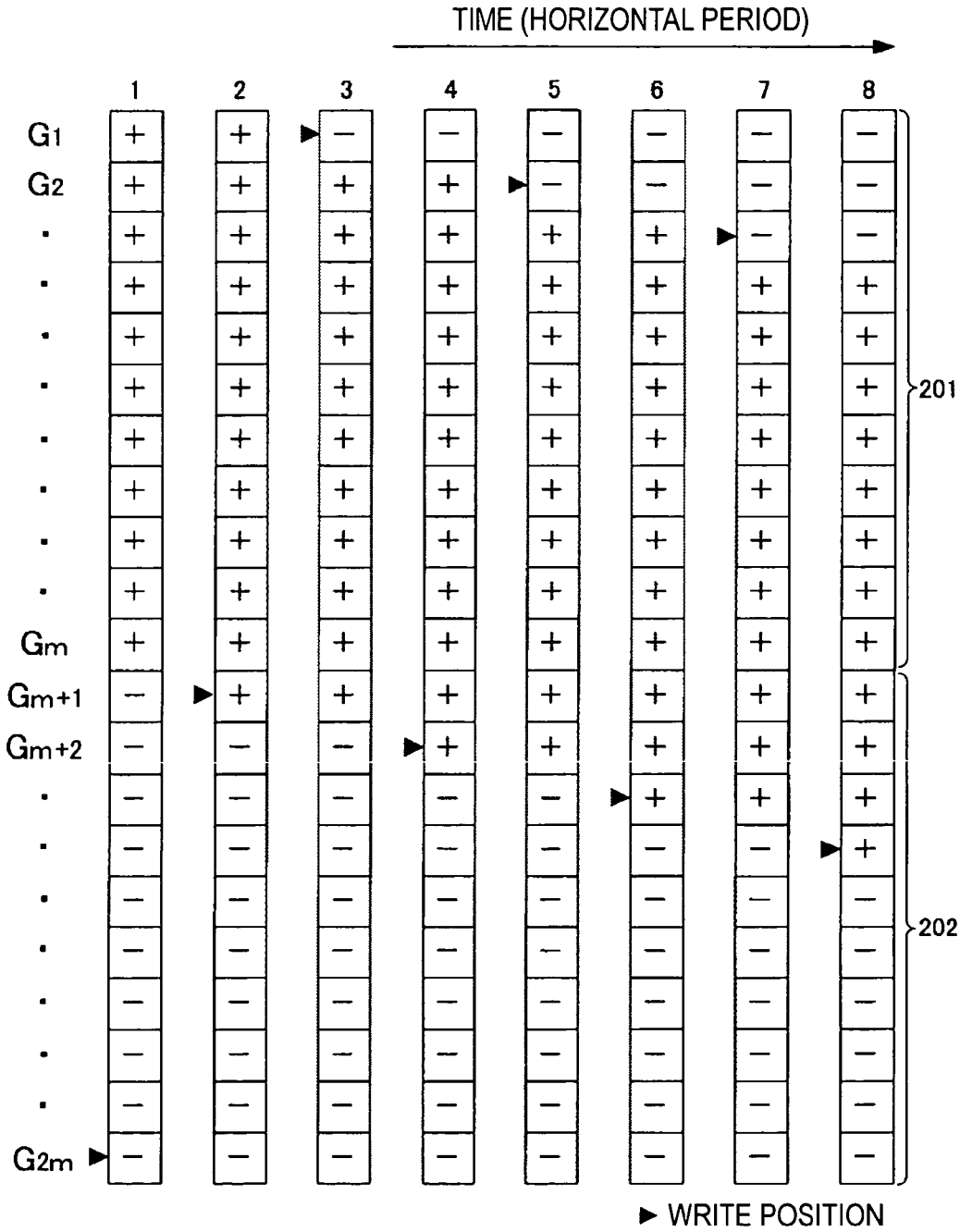
FIG. 7 is a diagram showing a method for driving the electro-optical device according to the first embodiment.
Figure 8:
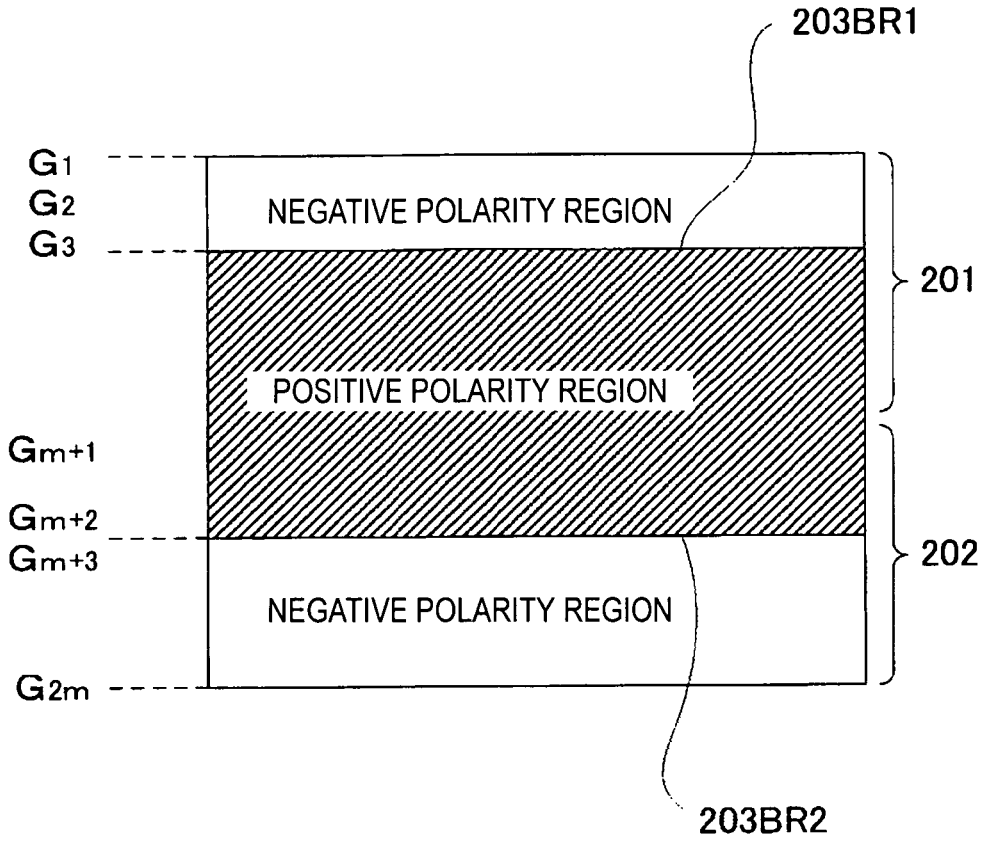
FIG. 8 is a diagram showing a method for driving the electro-optical device according to the first embodiment.

FIGS. 5 and 6 illustrate the concept of the driving method according to the first embodiment. FIG. 7 shows changes of polarities on the screen in a time-series manner, and FIG. 8 shows an instantaneous view on the screen for a given horizontal period.

Since overdriving is not considered at this time, it is assumed that the overdrive processing circuit 65 of the driving unit 60 is ignored and the image signal DATA1 output from the frame memory 62 or 63 is input to the DA converter 64. It is also assumed that the image signal DATA1 is a non-interlaced signal or a non-interlaced signal that is produced by field interpolation on a 2:1 interlaced signal using a known method before the image signal DATA1 is sent to the frame memory 62 or 63.

As shown in FIG. 5, a display screen is divided into a first upper screen section 201 and a second lower screen section 202, and pixel portions constituting the first screen section 201 and pixel portions constituting the second screen section 202 are driven with field/frame inversion so as to be inverted at intervals complementary to each other.

In FIG. 5, the polarity is inverted for every half a normal frame period. That is, the scanning line driving circuit 104 and the data lines driving circuit 101 are driven at double speed, and the image signal Sx corresponding to two screens is written to the first and second screen sections 201 and 202 for the period of one frame. Half of the frame, i.e., a period for which the screen is refreshed and displayed one time, is hereinafter referred to as a "unit period," if necessary. More specifically, frame data is divided into two data portions having opposite polarities, and these two data portions are overlaid using the frame memories 62 and 63 while being shifted by ½ the vertical period. The data line driving circuit 101 inverts the polarity of the image signal Sx for every ½ frame period, and also drives one screen so that the polarities of the image signal Sx in the first and second screen sections 201 and 202 differ from each other.

As shown in FIG. 6, groups of pixel portions constituting the first screen section 201 and groups of pixel portions constituting the second screen section 202 are horizontally scanned in an alternate manner. That is, the image signal Sx is written to the first and second screen sections 201 and 202 in a parallel manner. FIG. 7 shows the parallel writing in a time-series fashion.

In FIG. 7, for example, for the first horizontal period, the 2m-th scanning line 3*a* is scanned by a scanning signal G2*m*, and a negative image signal Sx is written. For the second horizontal period, the (m+1)-th scanning line 3*a* is scanned by a scanning signal Gm+1, and a positive image signal Sx is written to the pixel portion that is negative for the first horizontal period. For the third horizontal period, the first scanning line 3*a* is scanned by a scanning signal G1, and a negative image signal Sx is written to the pixel portion that is positive for the first and second horizontal periods. Such selection and writing are repeated for the following horizontal periods. When half of the screen, i.e., the first and second screen sections 201 and 202, has been scanned, the positive polarity region and the negative polarity region are inverted, and one screen is refreshed. This method allows two refreshes when the entire screen is scanned, and one vertical period for an input image signal is therefore halved.

As shown in FIG. 8, focusing on one horizontal period, for example, the pixel portions scanned by scanning signals G3 to Gm+2 define a region in which positive polarity data is written (hereinafter referred to as a "positive polarity region"), and the pixel portions scanned by scanning signals G1 to G2 and Gm+3 to G2*m* define a region in which negative polarity data is written (hereinafter referred to as a "negative polarity region"). Thus, a screen is separated into a positive polarity region and a negative polarity region. The polarities of the first and second screen sections 201 and 202 are inverted for every unit period.

In FIG. 8, boundaries 203BR1 and 203BR2 between the positive polarity region and the negative polarity region move downwards as vertical scanning proceeds in the screen. Degradation in image quality at the boundaries 203BR1 and 203BR2 caused by a lateral electric field is less visually noticeable by continuous vertical scanning in the screen without scanning at one location.

In the first embodiment, the positive polarity region and negative polarity region forming half of the screen are inverted for one vertical period, and the first and second screen sections 201 and 202 are driven with field/frame inversion at double speed. In one vertical period, the electric potentials of a given pixel portion and an adjacent pixel portion are opposite in polarity for a period of 2/2m, and are the same in polarity for the majority of the remaining time, i.e., for a period of (2m−2)/2m. Thus, alignment failure does not substantially occur in the liquid crystal layer 50 due to the lateral electric field.

The first and second screen sections 201 and 202 are inverted in signal polarity on the data lines 6*a*. Unlike field/frame inversion driving of the related art, location-dependent non-uniformity in the display can be avoided by making sure there is no great difference in the amount of charge leakage from the TFTs 30 between the upper and lower portions of the screen.

In the first embodiment, double-speed driving allows the scanning frequency to become 100 Hz or higher, which is two times higher than the input image signal frequency, and prevents flicker from being visually perceived.

Figure 9:
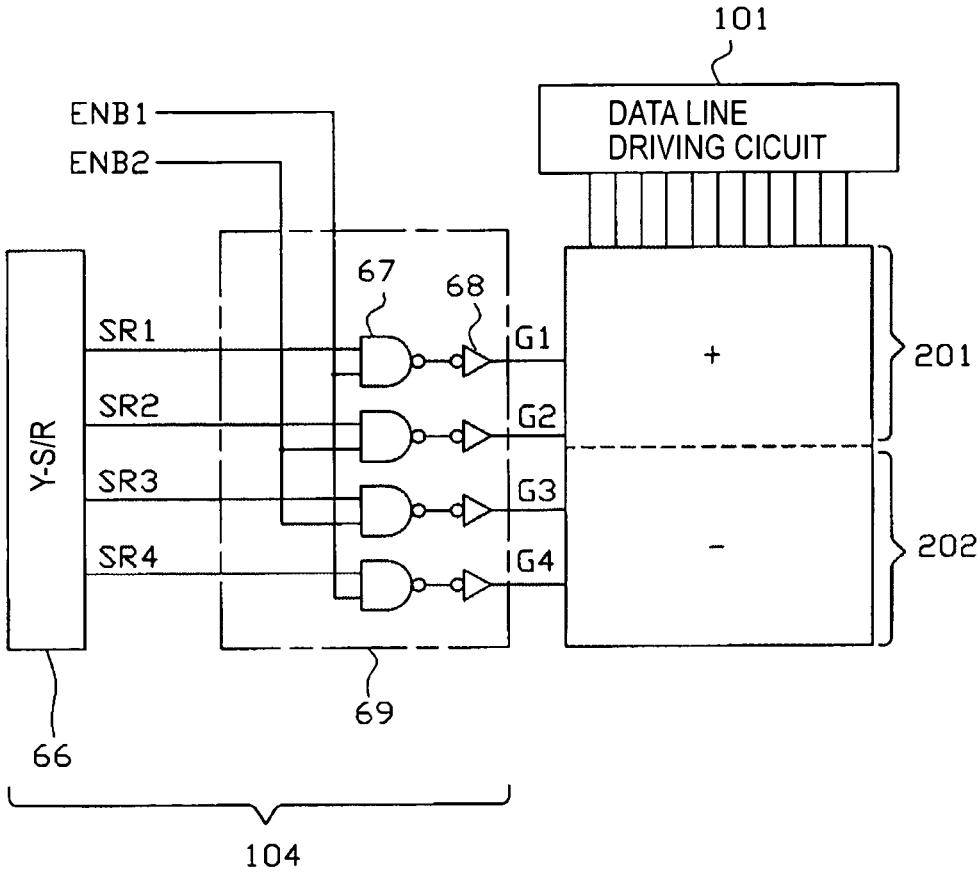
FIG. 9 is a circuit diagram of a circuit for driving the electro-optical device according to the first embodiment.

A driving circuit capable of implementing the driving method will now be described with reference to FIGS. 9 and 10. FIG. 9 illustrates the scanning line driving circuit 104 having four scanning lines, and FIG. 10 is a timing chart for the scanning line driving circuit 104 shown in FIG. 9.

As shown in FIG. 9, the scanning line driving circuit 104 includes a shift register 66 to which, for example, the clock signal CLY and the inverted clock signal CLY' are input from the controller 61 shown in FIG. 4, and an output controller 69 to which the output signals from the shift register 66 are input. The output controller 69 includes 2m logic circuits associated with 2m scanning lines 3*a*, and each logic circuit includes, for example, a NAND circuit 67 and a NOT circuit 68. The NAND circuits 67 receive output signals from the shift register 66 and the enable signal ENB1 or ENB2.

The enable signal ENB1 is connected to the first NAND circuit 67 in the first screen section 201, and is connected to the second (or, in the overall circuit, the fourth) NAND circuit 67 in the second screen section 202. The enable signal ENB2 is connected to the second NAND circuit 67 in the first screen section 201, and is connected to the first (or, in the overall circuit, the third) NAND circuit 67 in the second screen section 202. The enable signals ENB1 and ENB2 are therefore alternately connected to the NAND circuits 67.

Figure 10:
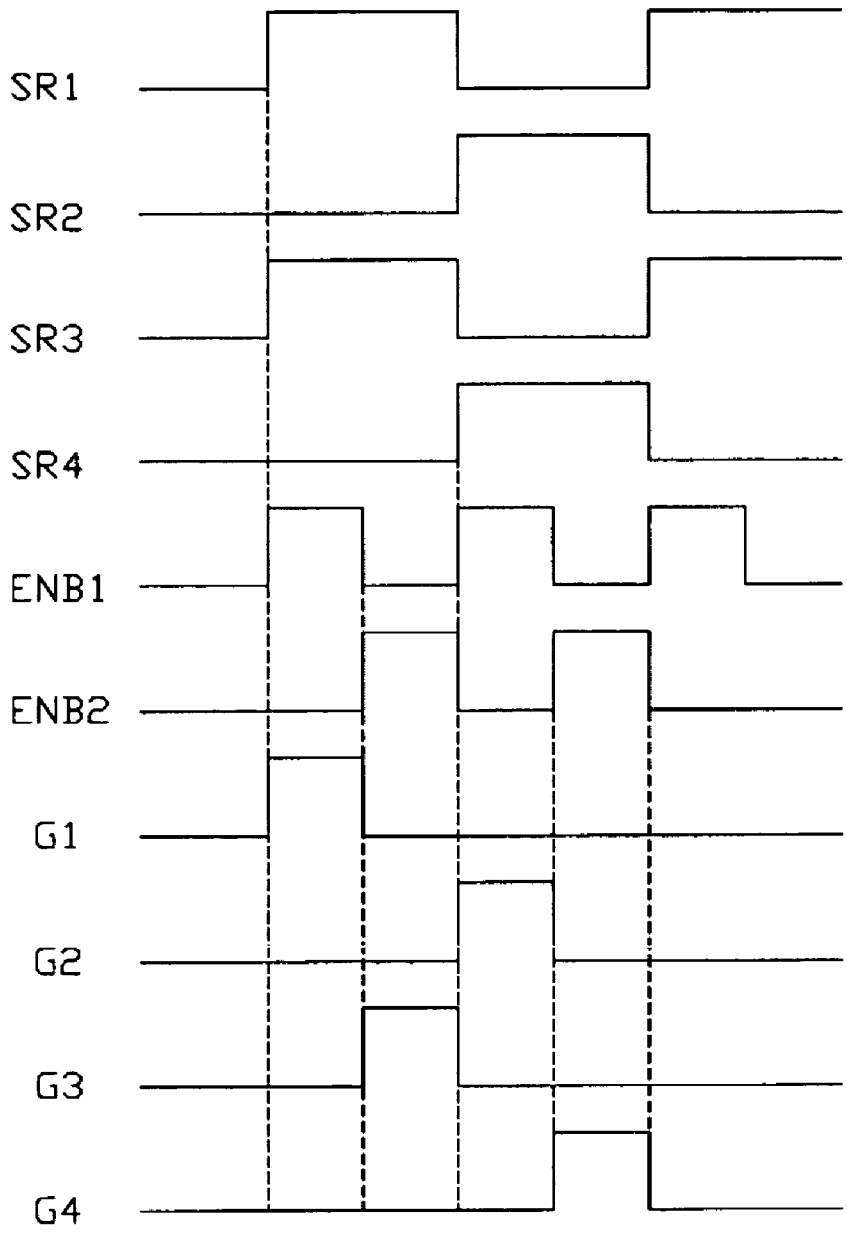
FIG. 10 is a timing chart for showing a method for driving the electro-optical device according to the first embodiment.

As shown in FIG. 10, start pulses SR1 to SR4 are output from the shift register 66 to the associated scanning lines 3*a* at an identical timing as if the first and second screen sections 201 and 202 were horizontally scanned simultaneously. Specifically, the start pulses SR1 and SR3 for the first scanning lines 3*a* in the first and second screen sections 201 and 202 and the start pulses SR2 and SR4 for the second scanning lines 3*a* in the first and second screen sections 201 and 202 are output alternately for every two horizontal periods. The enable signals ENB1 and ENB2 rise alternately for every horizontal period. The start pulse output at the rising time is selected by the logic circuit, and is output as a scanning signal to the scanning line 3*a*. Therefore, as shown in FIG. 10, the scanning signals G1 to G4 are output in the order of scanning signals G1, G3, G2, and G4, and the horizontal scanning described above is performed (see FIG. 6 or 7).

A driving method in combination with the double-speed inversion driving described above and overdriving will now be described with reference to FIGS. 11 to 13.

The circuit diagram for overdriving will be described with reference to FIG. 11. FIG. 11 illustrates an overdrive system in the driving unit 60.

Figure 11:
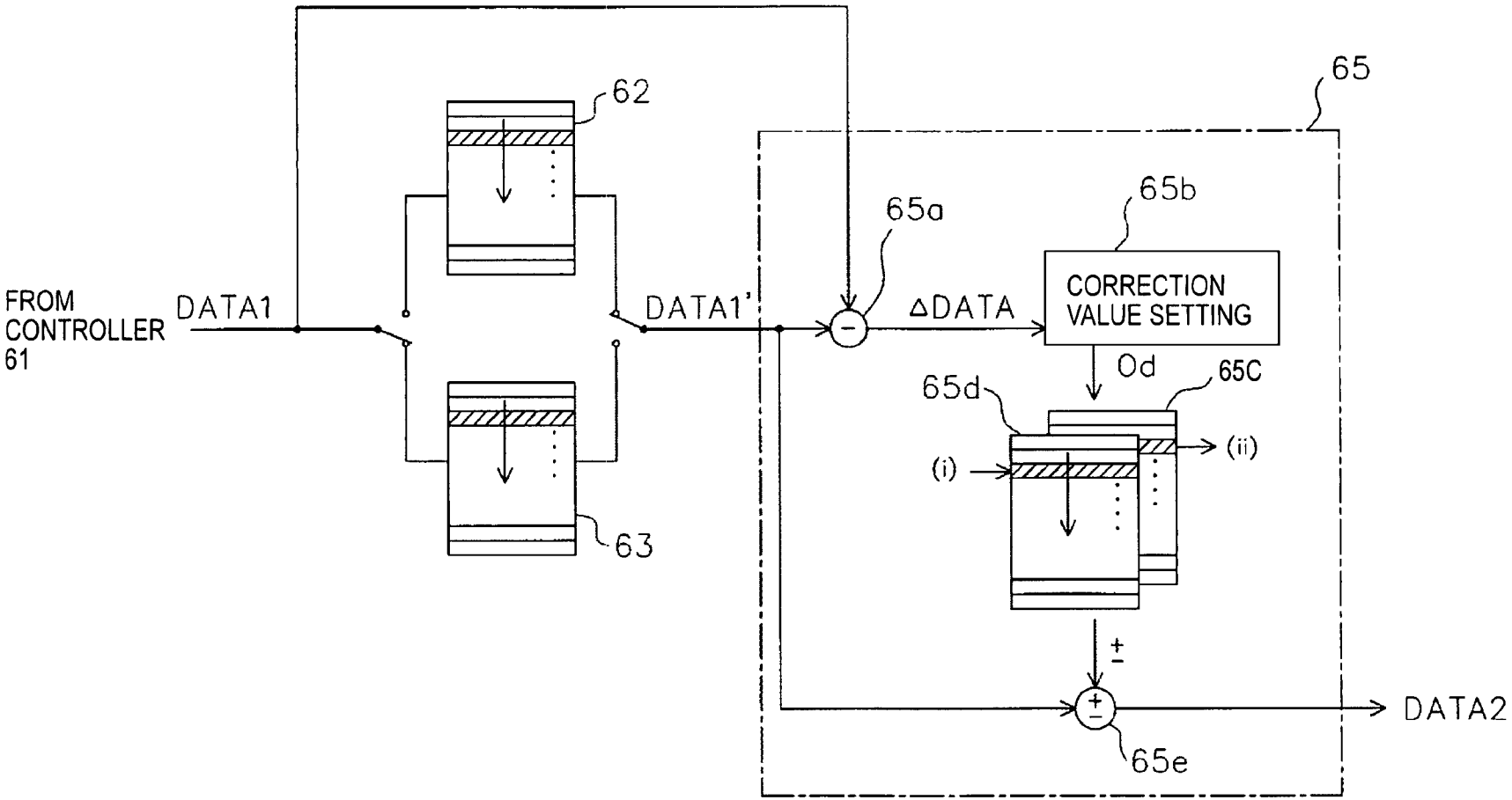
FIG. 11 is a block diagram of a brightness correction system in the driving system shown in FIG. 4.

In FIG. 11, the overdrive processing circuit 65 includes a subtractor 65*a*, a correction value setting unit 65*b*, frame memories 65*c* and 65*d*, and an adder/subtractor 65*e*. The subtractor 65*a* determines difference data ΔDATA between the image signal DATA1 from the controller 61 that has not been written in the frame memory 62 or 63 and an image signal DATA1' read from the frame memory 62 or 63. The difference data ΔDATA is determined in units of, for example, lines of the image signal, and the subtractor 65*a* includes a line memory for storing the image signals DATA1 and DATA1', the calculated difference data, etc. The difference data ΔDATA determined for luminance signals may be determined in units of pixels or pixel blocks in lieu of lines.

The correction value setting unit 65*b* serves as a correction unit, and sets and outputs a correction value Od based on the input difference data ΔDATA. The correction value Od indicates the amount of correction to be applied to the image signal DATA1 to increase the response rate of the liquid crystal to a brightness change on the screen, and is determined depending upon the difference data ΔDATA , the response performance of the liquid crystal in the liquid crystal layer 50 to the applied voltage, the polarity inversion period, etc. For example, the correction value Od may be set in advance in the form of table, or may be determined by transformation.

The frame memories 65*c* and 65*d* store the correction value Od output from the correction value setting unit 65*b*, and the correction value Od is written and read in synchronization with the operation timing of the frame memory 62 or 63.

The adder/subtractor 65*e* generates and outputs an image signal DATA2 obtained by correcting the image signal DATA1' for the brightness. More specifically, the adder/subtractor 65*e* adds or subtracts the correction value Od to or from the image signal DATA1'. The correction value Od is added to the image signal DATA1' if the liquid crystal driving voltage increases with respect to a brightness change over time between screens, and is subtracted from the image signal DATA1' if the voltage decreases. This depends upon the relationship between the image signal DATA1' to be corrected and the previous frame, and, for example, addition and subtraction are identified by the sign of the difference data ΔDATA .

The overdriving will further be described with reference to FIGS. 12 and 13. FIG. 12 shows flows of data in the circuit system shown in FIG. 11. FIG. 13 shows the relationship of the image signal DATA1 to be supplied to one pixel portion, the response characteristic of the liquid crystal, and the correction value Od. For convenience of illustration, the polarities of the image signal are ignored in FIG. 13.

The image signal DATA1 output from the controller 61 is input to the frame memory 62 or 63 for each frame. An image signal is synchronously written to and read from the frame memory 62 or 63 in units of lines, and the overall operation of the circuit system is performed in units of image signals DATA1 corresponding to one screen (i.e., one frame). In the signal processing period for one line, the image signal DATA1 written in the frame memory 62 is read as the image signal DATA1' by a reading operation synchronous with the writing to the frame memory 63, and is then input to the subtractor 65*a* and the adder/subtractor 65*e* of the overdrive processing circuit 65.

Figure 12:
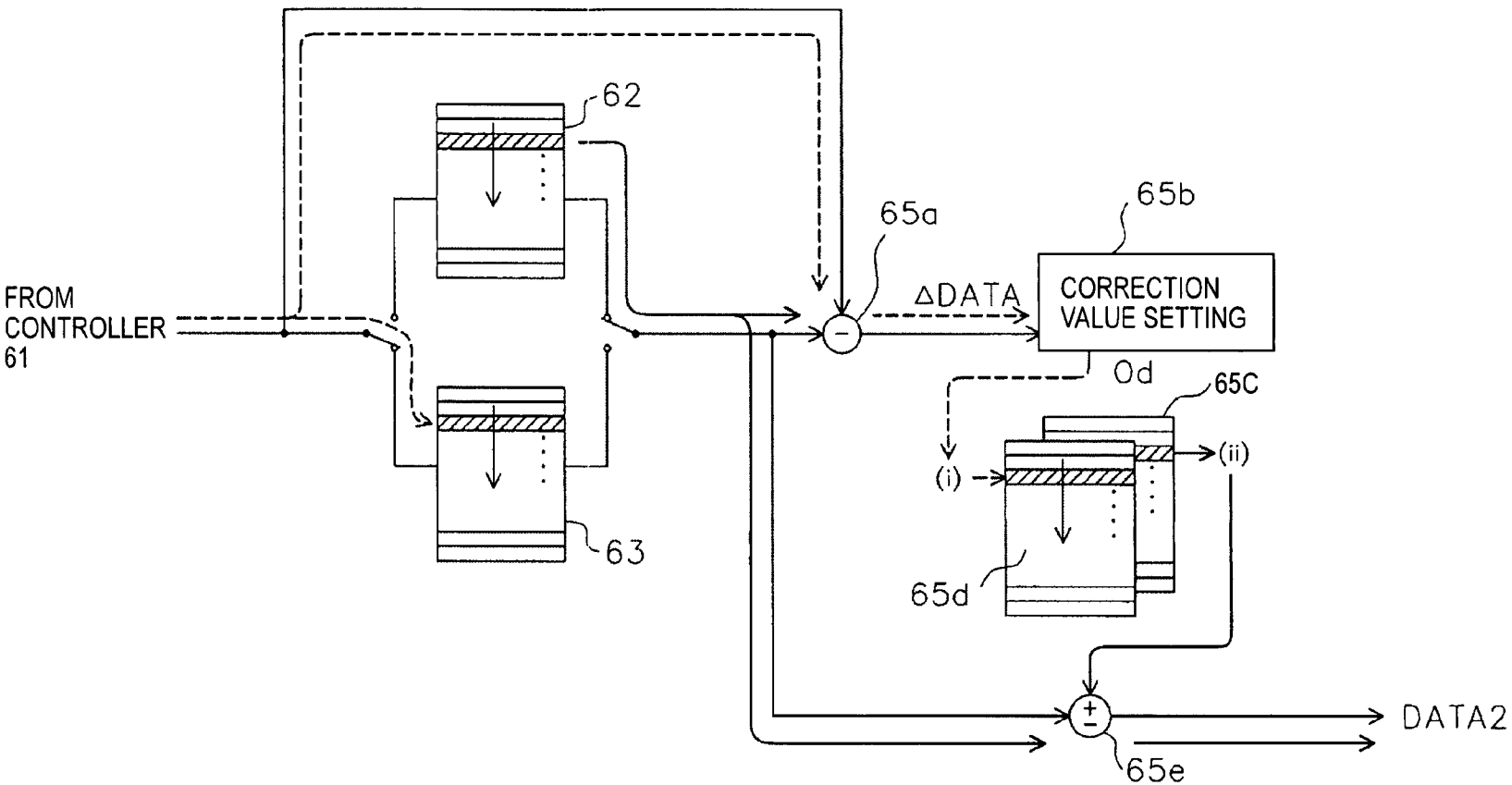
FIG. 12 is a diagram showing a signal path when the circuit system shown in FIG. 11 operates.

As shown in FIG. 12, the subtractor 65*a* receives the image signal DATA1 that has not been written in the frame memory 63. The image signal DATA1 indicates a screen subsequent to the screen indicated by the image signal DATA1' in the subtractor 65*a*. With double-speed driving, the image signal DATA1 is identical on a frame basis, and the identical image signal DATA1 is written to the frame memories 62 and 63. The subtractor 65*a* determines the difference data ΔDATA between the image signal DATA1 and the image signal DATA1' in units of lines. The difference data ΔDATA corresponds to the amount of brightness change between frames, and is sequentially input to the correction value setting unit 65*b*.

The correction value setting unit 65*b* sets the correction value Od for the image signal DATA1 corresponding to one screen using the difference data ΔDATA as a parameter. Generally, the larger the difference data ΔDATA , the larger the correction value Od. The smaller the difference data ΔDATA , the smaller the correction value Od. In the first embodiment, the polarity inversion period is also considered. During polarity inversion, the image signal DATA1' changes more than during non-inversion. It is therefore necessary to set the correction value Od larger. More specifically, the correction value Od is determined by using a preset table including correction values Od or by replacing the difference data ΔDATA used as a parameter in a predetermined transformation. If the image signal DATA1 and the image signal DATA1' are signals of an identical frame, a brightness change does not occur, and the correction value Od is therefore set to zero. The difference data ΔDATA is line data, and the correction value Od is set and output in units of lines.

The correction value Od set in the correction value setting unit 65*b* indicates the amount of correction to be applied to the image signal DATA1 written in the frame memory 63. The correction value Od is temporarily stored in the frame memory 65*d*, as indicated by (i) in FIGS. 11 and 12. The frame memory 65*c* stores the correction value Od for the image signal DATA1' read from the frame memory 62. The correction value Od stored in the frame memory 65*c* is read in units of lines, as indicated by (ii) in FIGS. 11 and 12, and is sequentially input to the adder/subtractor 65*e*. In this way, the frame memories 65*c* and 65*d* are associated with the frame memories 62 and 63.

The correction value Od input to the adder/subtractor 65*e* is added to or subtracted from the image signal DATA1' sequentially input to the adder/subtractor 65*e*. Therefore, the image signal DATA2 corrected for the brightness according to the first embodiment, or the image signal DATA2 corrected by overdriving, is obtained, and an image is displayed based on the image signal DATA2.

The image signal DATA2 obtained by correcting the image signal DATA1' read from the frame memory 62 for the brightness is output, and the correction value Od for the image signal DATA1 corresponding to the next unit period is set and written to the frame memory 63. The processing described above is performed on the image signal DATA1' output alternately from the frame memories 62 and 63 for every unit period.

Figure 13:
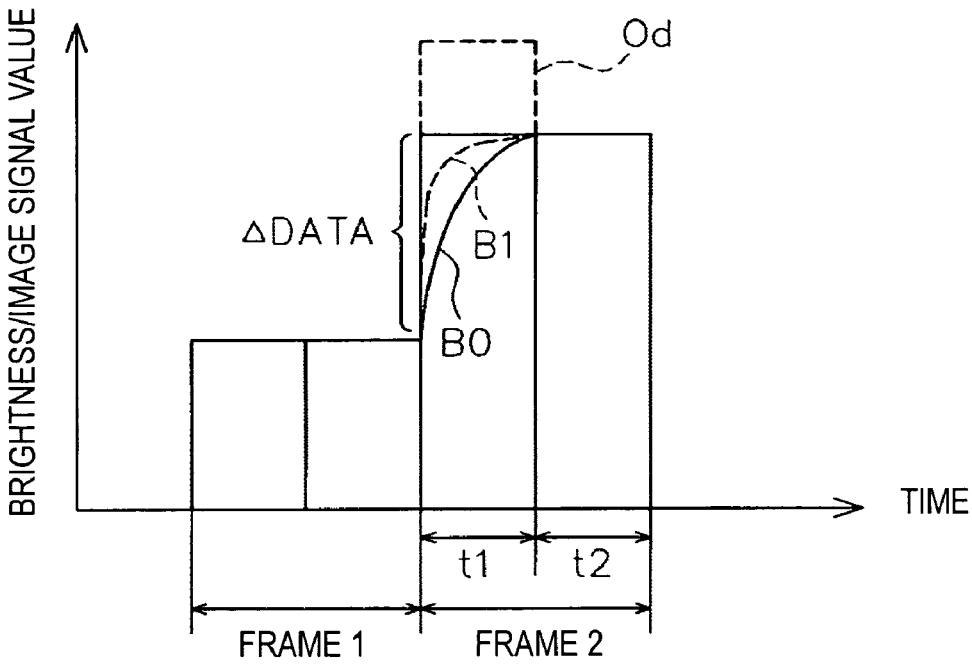
FIG. 13 is a plot showing image signal processing performed by the circuit system shown in FIG. 11 and a response characteristic of liquid crystal.

As shown in FIG. 13, when the value of the image signal DATA1 varies in a given pixel portion between frame 1 and frame 2, the applied voltage rapidly changes in the liquid crystal layer 50 of this pixel portion. However, if the response speed of the liquid crystal to the applied voltage is low, the electro-optical device whose brightness is modulated by the liquid crystal has a transition period of brightness B0. If a change of the image signal DATA1 is not followed and the brightness B0 slowly changes, the brightness becomes insufficient in the frame 2 after the change. This phenomenon is perceived as display blur or the like. For example, when a white image moves on a black background, the trajectory of the white image is perceived as a white trailing tail, resulting in afterimage artifacts.

In contrast, as described above, the correction value Od is added to the image signal DATA1 to increase the value of the image signal DATA1, thus accelerating the nominal response of the liquid crystal according to the signal value. Therefore, the picture of frame 2 is displayed with brightness B1. This overdriving can reduce the brightness transition time and can compensate for effective luminance to maintain high image quality.

In order to achieve instantaneous response of the liquid crystal to a change of the image signal to exhibit a sharp rising or falling edge in brightness, it is desirable to correct the image signal DATA1 early in the changing time. In the first embodiment, the image signal DATA1 changes on a frame basis. Although a brightness change may occur between adjacent frames, identical pictures are displayed in unit periods in a given frame (e.g., unit periods t1 and t2 in frame 2) during double-speed driving, and the brightness change is therefore negligible. For this reason, in the first embodiment, the brightness is corrected for in a unit period immediately after the previous frame period (i.e., in the first unit period). For example, in frame 2, the correction value Od for the value of frame 1 is added to the image signal written only in the unit period t1. That is, one frame period corresponds to a screen display period, and half of the frame period corresponds to a unit period.

Therefore, afterimage artifacts on the display screen due to response delay of the liquid crystal can be efficiently reduced or overcome. With the driving method in which compensation is performed in the unit period t1 and is not performed in the unit period t2 in one frame period, the time for applying an excessive voltage as a correction value can be minimized with respect to the overall driving period, and image quality degradation on the liquid crystal screen can be suppressed.

In order to perform the compensation only in a particular period, a switch or the like may be used to branch the path of the image signal DATA1' so as to control the timing at which the image signal DATA1' is output to the overdrive processing circuit 65. In this case, the overdriving circuit 65 is bypassed, and the image signal DATA1' that is not to be corrected is output directly to the controller 61. However, the image signal DATA1' supplied in a non-correction period, such as the unit period t2, is identical to the image signal DATA1' supplied in the unit period t1, and the former signal that is input to the overdriving circuit 65 is not substantially corrected. Thus, the circuit structure described above (see FIG. 11) also allows the correction described above. However, it is preferable to limit a correction period when the memories are shared with other processing and when unnecessary processing is omitted.

In the foregoing description, the frame memories 65*c* and 65*d* store the correction value Od. In one unit period, a single frame memory may be used to read the correction value Od written (as indicated by (ii) in FIG. 11) and then to write the correction value Od output from the correction value setting unit 65*b* (as indicated by (i) in FIG. 11), thus realizing a simple circuit structure.

According to the first embodiment, therefore, in the double-speed inversion driving method, an image signal supplied in the first unit period in each frame is corrected by overdriving. Thus, the nominal response of the liquid crystal can be accelerated while preventing or reducing a lateral electric field and flicker to improve the image quality.

Second Embodiment

An electro-optical device according to a second embodiment of the invention will now be described with reference to FIGS. 14 and 15.

Figure 14:
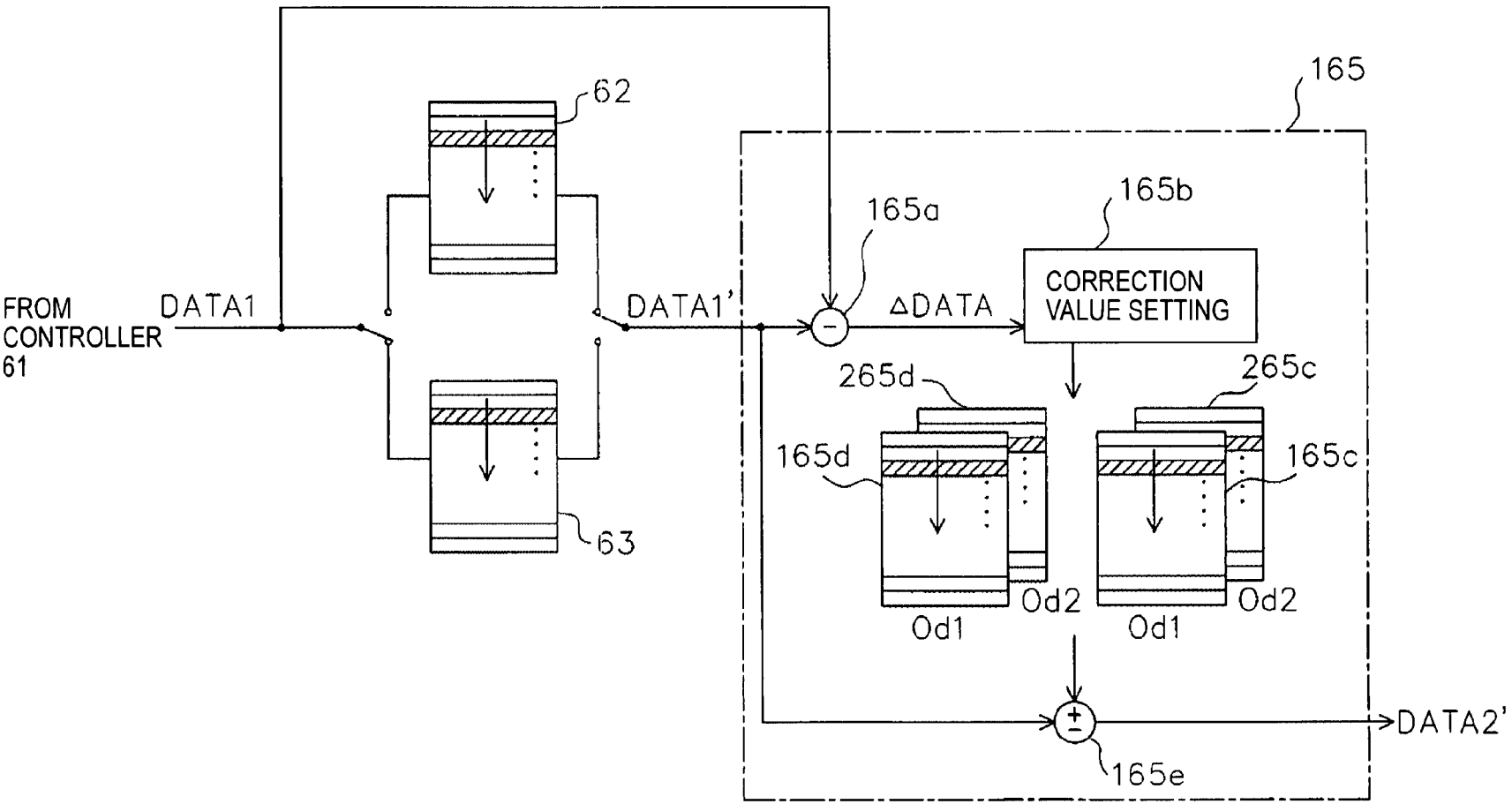
FIG. 14 is a block diagram of a main circuit system in an electro-optical device according to a second embodiment of the invention.
Figure 15:
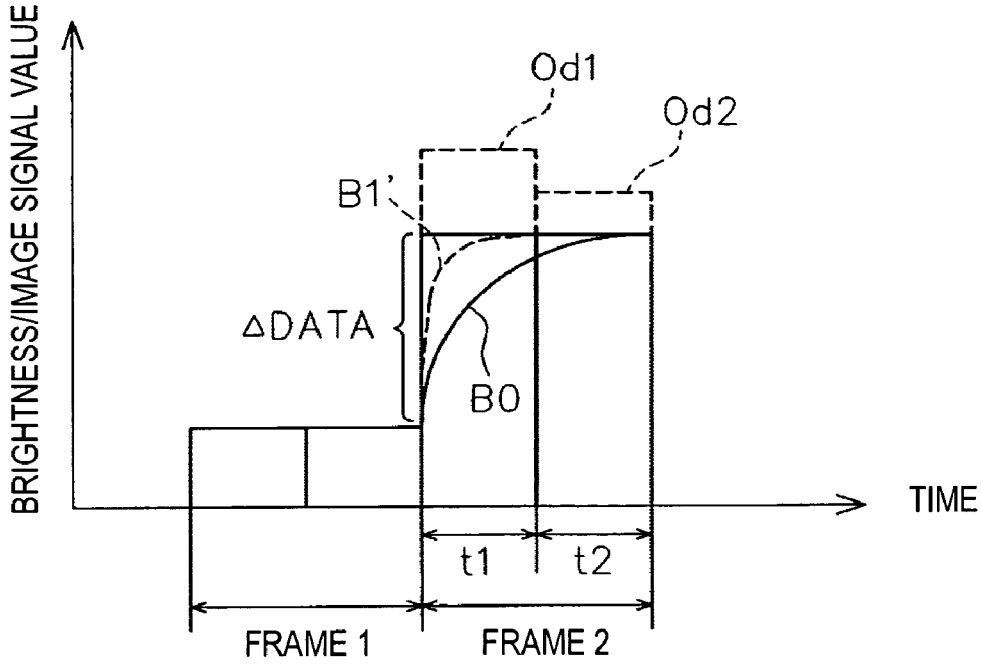
FIG. 15 is a plot showing image signal processing performed by the circuit system shown in FIG. 14 and a response characteristic of liquid crystal.

FIG. 14 shows the structure of a main portion of the electro-optical device according to the second embodiment, and FIG. 15 shows a method for driving the electro-optical device according to the second embodiment. FIGS. 14 and 15 correspond to FIGS. 11 and 13 showing the first embodiment, respectively. The structure of the electro-optical device according to the second embodiment and the basic method for driving the electro-optical device are substantially similar to those of the first embodiment. The same components as those of the first embodiment are assigned the same reference numerals, and a description thereof is omitted.

In FIG. 14, an overdrive processing circuit 165 corrects image signals DATA1 supplied in unit periods t1 and t2 in each frame period with weighted correction values Od1 and Od2, respectively, and outputs an image signal DATA2'. That is, the amount of correction is distributed from the first unit period t1 that can be the most effective to correct for the brightness to the following unit period t2.

The correction value setting unit 165*b* sets the correction value Od1 for the unit period t1 and the correction value Od2 for the unit period t2, as shown in, for example, FIG. 15, depending upon the input difference data ΔDATA . The correction values Od1 and Od2 are weighted so that the correction value Od1 is greater than the correction value Od2.

Also in the second embodiment, the correction values are set considering the effect of polarity inversion. The correction values Od1 and Od2 are set larger than those without inversion, thus allowing correction for not only a brightness change involved with a change in a motion picture but also a periodic brightness change resulting from polarity inversion.

The set correction values Od1 and Od2 are stored in either the set of the frame memories 165*c* and 265*c* or the set of the frame memories 165*d* and 265*d*, and are output to the adder/subtractor 165*e* when the image signal DATA1' to be corrected is read from the frame memory 62 or 63 and is output to the adder/subtractor 165*e*. Two sets of frame memories for reading and writing, i.e., a total of four frame memories, are provided to collectively set the correction values Od1 and Od2 on a frame basis.

The adder/subtractor 165*e* adds or subtracts the correction values to or from the image signal DATA1' for every unit period, and the image signal DATA2' to which the weighted corrections are applied is output.

This compensation is useful particularly when the response of the liquid crystal is not sufficient with compensation performed in the first unit period t1, e.g., when the amount of brightness change is large or the response speed of liquid crystal is low. The voltage applied to the liquid crystal is increased during writing in the unit period t1 and during writing in the unit period t2. Thus, changes of alignment of the liquid crystal in this frame period can be accelerated, and the nominal response speed of the liquid crystal can efficiently be increased.

In the second embodiment, therefore, similar advantages to those of the first embodiment can be achieved. In addition, compensation for every unit period allows correction for not only a brightness change involved with a change in a motion picture but also a periodic brightness change resulting from polarity inversion. Compensation is performed stepwise in unit periods t1 and t2, thus reducing the amount of correction in the unit period t1 compared to correction performed only in the unit period t1. Therefore, image quality degradation on the liquid crystal screen caused by larger voltage variations due to correction of the image signal DATA1' can be suppressed.

For convenience of illustration, the polarities of the image signal are ignored in FIGS. 13 and 15. It is difficult for the liquid crystal to follow a brightness change irrespective of polarity inversion and the polarity inversion period before and after the brightness greatly changes in a motion picture, e.g., between frames with a large brightness change with respect to the time axis, as shown in FIGS. 13 and 15. In other words, without a specific brightness change, the liquid crystal can follow brightness changes irrespective of polarity inversion or the polarity inversion period even if the response speed is relatively low. Thus, without a brightness change, images can be displayed with a constant brightness irrespective of the response speed of the liquid crystal. In the second embodiment, overdriving is performed in the unit period t1 corresponding to the first half of the frame period after the brightness largely changes. This is effective for the liquid crystal to follow a brightness change in various polarity inversion periods or polarity inversion methods.

In the first and second embodiments described above, the polarities are inverted for every unit period. The polarities may be inverted for every frame period. In particular, in the first embodiment, signals having the same polarity are applied successively in the unit periods t1 and t2, and the correction effect in the unit period t1 still continues in the unit period t2. Therefore, the correction performed only in the unit period t1 becomes more effective.

One frame period is divided into the unit periods t1 and t2. One frame period may be divided into more unit periods (t1, t2, . . . , tn, where n is a natural number), and n-times speed driving may be achieved. The image signal may be corrected by a weighted correction value in all unit periods or in a particular unit period, e.g., the unit periods t1 and t2.

In the embodiments described above, the display screen is divided into two screen sections for polarity inversion driving at intervals complementary to each other. The number of screen sections divided is not limited to two, and may be more than two. However, the larger the number of screen sections divided, the larger the number of boundaries between screen sections at which lateral electric fields are generated. Due to the limit imposed by the performance of high-frequency circuit components, actually, the display screen is preferably divided into two screen sections for driving.

Figure 16:
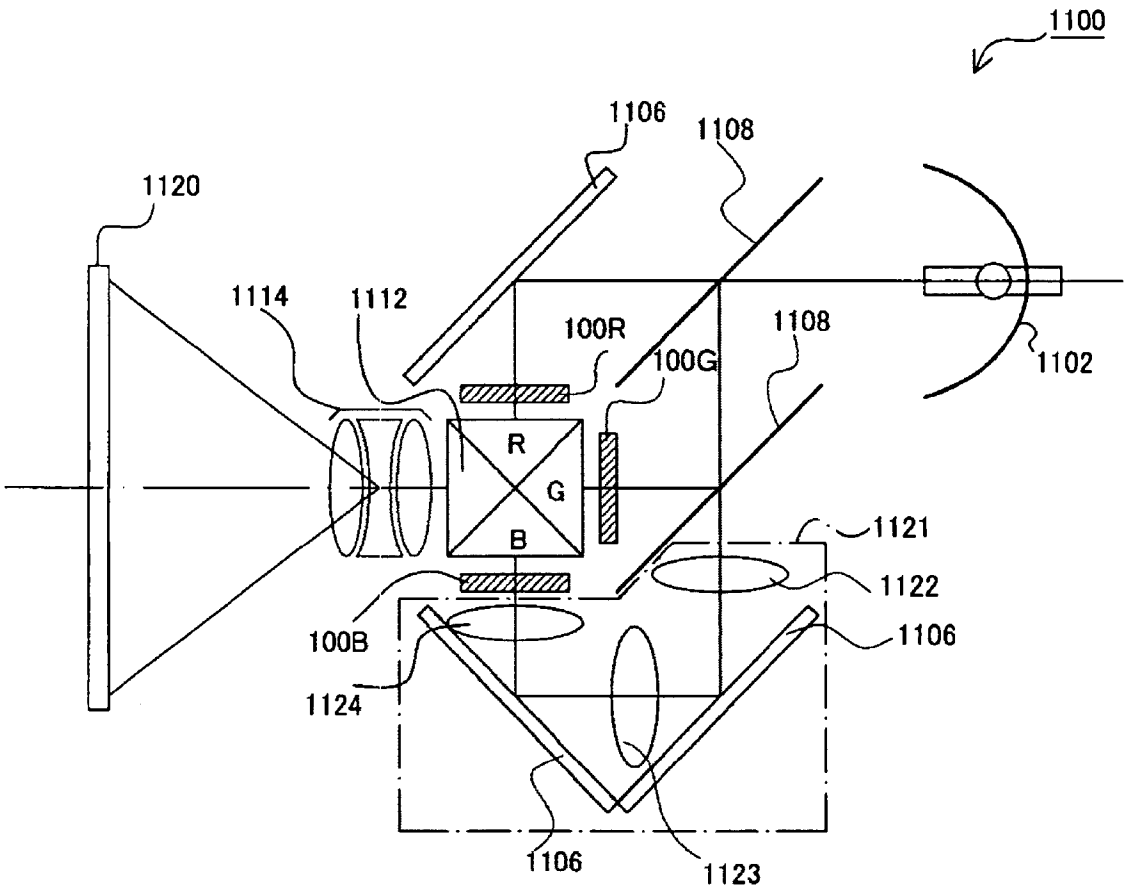
FIG. 16 is a schematic cross-sectional view of an electronic apparatus including the electro-optical device according to an embodiment of the invention.

An electronic apparatus using the electro-optical device described above in detail as a light valve will be described with reference to FIG. 16 in the context of a projection color display device. FIG. 16 is a schematic cross-sectional view of the projection color display device.

In FIG. 16, a liquid crystal projector 1100 as an example of the projection color display device according to the first or second embodiment uses three liquid crystal modules including liquid crystal devices each having a driving circuit mounted on a TFT array substrate as RGB light valves 100R, 100G, and 100B. In the liquid crystal projector 1100, light emitted from a lamp unit 1102, which is a white light source, such as a metal halide lamp, is separated by three mirrors 1106 and two dichroic mirrors 1108 into light components R, G, and B corresponding to three primary colors R, G, and B. The light components R, G, and B are guided into the light valves 100R, 100G, and 100B, respectively. In particular, the light component B is guided through a relay lens system 1121 including an incident lens 1122, a relay lens 1123, and an emitting lens 1124 to reduce or prevent the loss of light due to its long optical path. The light components R, G, and B modulated by the light valves 1000R, 100G, and 100B, respectively, are synthesized by a dichroic prism 1112 and are then projected as a color image with enlargement onto a screen 1120 via a projection lens 1114.

The projection color display device includes the electro-optical device according to the first or second embodiment, thus allowing high-definition high-uniformity display without noise, such as flicker. In particular, a motion picture can be displayed with high quality without display blur.

The invention is not limited to the foregoing embodiments, and a variety of modifications may be made without departing from the spirit and scope of the invention, which can be read from the appended claims and the whole document. Such modifications of the circuit and method for driving the electro-optical device, the electro-optical device, and the electronic apparatus also fall within the technical field of the invention.

The illustrated embodiments have been described in the context of an active-matrix liquid crystal device including TFTs, by way of example. The invention is not limited to this type of liquid crystal device, and is also applicable to, for example, a liquid crystal device including thin-film diode (TFD) pixel switching devices or a passive-matrix liquid crystal device. Other than liquid crystal devices, electro-optical devices capable of matrix driving with temporal or spatial polarity inversion and capable of luminance modulation using an electro-optical material responsive to an image signal, e.g., an electrophoretic device, also fall within the scope of the invention.

What is claimed is:

1. A circuit for driving an electro-optical device including a plurality of pixel portions that contain an electro-optical material responsive to an electric signal, comprising:

a driving unit that supplies an image signal corresponding to one screen to the pixel portions in each of a plurality of unit periods into which a screen display period for displaying the one screen is divided so that the pixel portions are driven a plurality of times in the screen display period; and a correction unit that corrects the image signal supplied in the first unit period of the plurality of unit periods in the same screen display period with correction data, the correction data being determined using:

the amount of difference between the image signal and an image signal supplied in a screen display period previous to the first unit period; and a response speed of the electro-optical material to the image signal.

2. The circuit according to claim 1, wherein the correction unit does not correct an image signal that is supplied in the unit periods other than the first unit period in the same screen display period.

3. The circuit according to claim 1, wherein the correction unit corrects an image signal that is supplied in the unit periods other than the first unit period in the same screen display period and the image signal supplied in the first unit period using weighted correction values.

4. The circuit according to claim 1, wherein the correction unit determines a luminance difference between the image signal supplied in the first unit period and the image signal supplied in the previous screen display period to set a correction value according to the determined difference, and corrects the image signal supplied in a designated unit period including the first unit period based on the set correction value.

5. The circuit according to claim 1, wherein the driving unit drives the pixel portions so that polarities of the pixel portions are inverted with respect to a reference voltage for every screen display period or for every unit period.

6. The circuit according to claim 5, wherein the driving unit drives a display screen composed of the plurality of pixel portions, the display screen is divided into a plurality of screen sections including a first screen section composed of groups of pixel portions and a second screen section composed of groups of pixel portions, the first and second screen sections being adjacent to each other, the groups of pixel portions constituting the first screen section being not adjacent to each other, by horizontally scanning the groups of pixel portions constituting the first screen section and the groups of pixel portions constituting the second screen section in an alternate manner so that the groups of pixel portions constituting the first screen section are driven with field/frame inversion at a first interval and the groups of pixel portions constituting the second screen section are driven with field/frame inversion at a second interval complementary to the first interval.

7. An electro-optical device comprising:

the circuit according to claim 1; and the plurality of pixel portions.

8. An electronic apparatus comprising the electro-optical device according to claim 7.

9. A method for driving an electro-optical device including a plurality of pixel portions that contain an electro-optical material responsive to an electric signal, comprising:

supplying an image signal corresponding to one screen to the pixel portions in each of a plurality of unit periods into which a screen display period for displaying the one screen is divided so that the pixel portions are driven a plurality of times in the screen display period; and correcting the image signal supplied in the first unit period of the plurality of unit periods in the same screen display period with correction data, the correction data being determined using the amount of difference between the image signal and an image signal supplied in a screen display period previous to the first unit period and a response speed of the electro-optical material to the image signal.

* * * * *